United States Patent [19]

Hamatani

[11] Patent Number: 4,625,953

[45] Date of Patent: Dec. 2, 1986

[54] SHEET SEPARATING DEVICE

[75] Inventor: Tohru Hamatani, Chiba, Japan

[73] Assignee: Hi-Tec Seiko Company Ltd., Chiba, Japan

[21] Appl. No.: 734,108

[22] Filed: May 15, 1985

[51] Int. Cl.[4] ..... B65H 3/08

[52] U.S. Cl. ..... 271/1; 271/98; 271/102; 271/103; 294/64.1; 414/116; 414/121

[58] Field of Search ..... 294/64.1, 64.3; 414/116, 121; 271/1, 90, 97, 98, 102, 103

[56] References Cited

U.S. PATENT DOCUMENTS

| | | | |
|---|---|---|---|
| 2,523,157 | 9/1950 | Somma | 294/64.1 X |
| 3,515,424 | 6/1970 | Sjodin | 294/64.1 |
| 4,553,892 | 11/1985 | Huffman | 294/64.1 X |

OTHER PUBLICATIONS

IBM Technical Disclosure Bulletin, vol. 23, No. 5, Oct. 1980, M. J. Haney et al., "Pickup Head for Apertured Flat Members".

*Primary Examiner*—Richard A. Schacher

*Attorney, Agent, or Firm*—Shlesinger Arkwright Garvey & Fado

[57] ABSTRACT

A sheet separating device for separating flexible disc-shaped sheet materials forming a stack. The sheet materials such as floppy discs have holes in the center thereof in register with each other to define a single hole in the stack. The sheet separating device of the invention includes an outer member having a chamber therewithin and an inner member provided in the chamber. The outer member has a contact surface in facing relation to the stack. The chamber within the outer member has an opening in the contact surface through which the inner member also faces the stack. The chamber is communicated with a vacuum source. The opening and the inner member have diameters larger than the holes in the discs. When the vacuum source operates, the inner edge of the floppy discs is drawn up by suction force from a gap defined by the outer member and inner member until the drawn edge of the floppy disc is blocked by the inner member. As a result, the disc is sucked to the device and separated from the stack.

5 Claims, 11 Drawing Figures

SHEET SEPARATING DEVICE

BACKGROUND OF THE INVENTION

This invention relates to a sheet separating device for separating flexible disc-shaped sheet materials such as floppy discs one by one from a stack of such sheet materials which have holes formed therein.

In a process for producing flexible disc-shaped sheet materials each having a hole formed therein, a stack of such sheet materials are sometimes fed to a subsequent next step.

In such a case, the flexible disc-shaped sheet materials are often contacted so closely with one another that they cannot be separated easily from one another. Accordingly, when the sheet materials are to be fed to a next step, air is blown from an air nozzle 1 to an upper side portion of a stack 3 of sheet materials 2 as shown in FIG. *7a* to float an uppermost one and some underlying ones of the sheet materials to provisionally separate them, and then a vacuum pad 4 is operated to attract and draw up an end portion of the uppermost sheet material 2. In order to improve the separating efficiency, a rotary vacuum pad 5 as shown in FIG. *7b* may otherwise be used.

However, in such separating devices as described above, an air-blown position is apt to be displaced since stacks 3 of sheet materials 2 are fed one after another to a position or height of the air nozzle 1 each time a sheet material 2 is to be separated. If such displacement occurs, a plurality of sheet materials 2 may be floated or otherwise sheet materials 2 cannot be floated sufficiently. In case sheet materials 2 are not floated sufficiently, the vacuum pad 4 which has no separating function cannot draw up nor separate the sheet materials 2. Even with the rotary vacuum pad 5 which has a separating function, where sheet materials 2 are not floated sufficiently, there is some limitation to separation of the sheet materials 2 from other sheet materials 2 below by making use of an elastic reactive force of end portions of the sheet materials 2, and if the contacting force is superior to the elastic force, the sheet materials 2 cannot be separated.

Thus, the conventional sheet separating devices have a defect that a separating operation cannot be assured because they employ an unstable air blowing system and a sheet material is attracted at an end portion thereof which presents a low elastic reactive force. Accordingly, a plurality of sheet materials may be fed sometimes and no sheet materials may be fed at other times, resulting in possible occurrence of stopping of a machine for a subsequent next step due to possible troubles caused thereby.

SUMMARY OF THE INVENTION

The present invention has been made in consideration of such circumstances as described above, and it is an object of the invention to provide a sheet separating device which can assuredly separate sheet materials one by one.

The present invention has been made with attention paid to the fact that a sheet material can be assuredly separated by attracting and turning up an inner circumferential portion around a hole of the sheet material member which presents a strong elastic reactive force. According to the invention, there is essentially provided a sheet separating device for separating flexible disc-shaped sheet materials from a stack thereof, respective sheet materials having holes in the center thereof in register with each other to define a single hole in said stack, said sheet separating device comprising an outer member having a contact surface extending in a place, said outer member being driven to bring said contact surface into and out of contact with said stack, said other member having a suction chamber therein, said suction chamber having an opening in said contact surface, said opening having a size large enough and adapted to surround said single hole in the stack; vacuum source means connected to said suction chamber to draw an inner edge of a sheet material in contact with the contact surface of said outer member, said inner edge defining the hole of said sheet material; and an inner member housed in said suction chamber to define a suction gap in cooperation with said outer member, said inner member having a size larger than said opening to block said drawn inner edge of the top sheet material.

Said sheet separating device is first placed on a stack of flexible disc-shaped materials each having a hole in the center thereof such that the opening formed in the contact surface of the outer member is positioned to surround a single hole defined in the stack by the holes of the flexible disc-shaped sheet materials. When the vacuum source connected to the suction chamber within the outer member is driven to operate, the inner edge of the top sheet material is drawn by the suction coming through the gap defined by the outer and inner members until it is blocked by the inner member overhanging the said inner edge of the sheet material. Thus, the general structure is raised, the top sheet material sticking to the device is also raised and separated from the stack.

The sheet material thus separated is fed to a predetermined position while it is held attracted by the suction from the gap, and then the attracting force is removed to allow the sheet material to be released from the device. Thereafter, a similar sequence of operations will be repeated.

Figure 3:
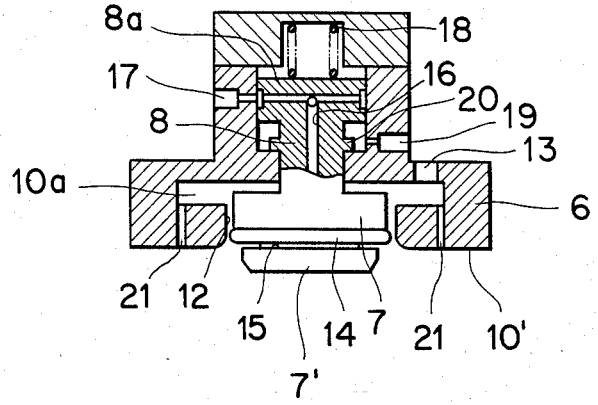
Figure 4:
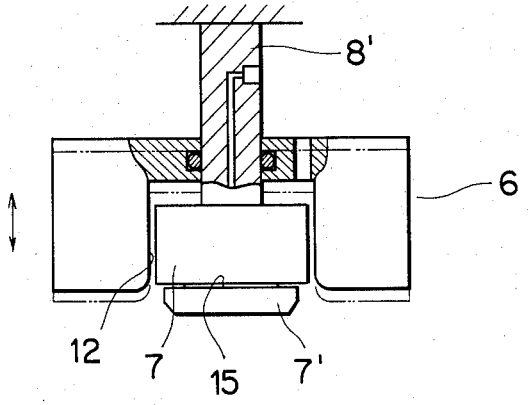
Figure 5:
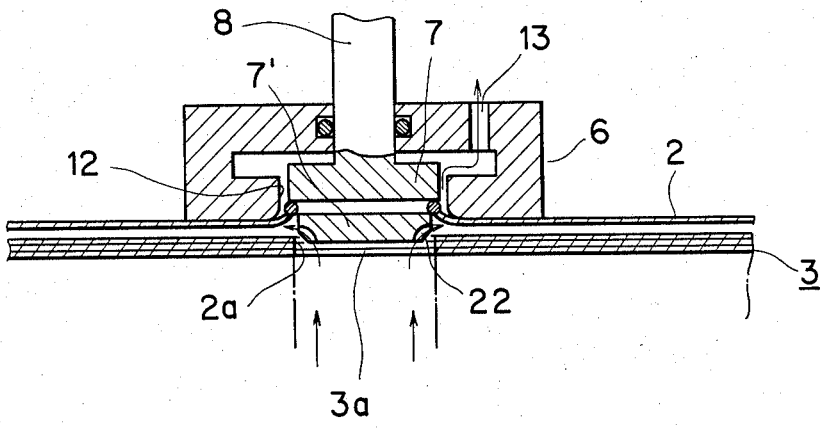

FIGS. *2a* through *2c* are views for illustrating operations thereof;

FIGS. 3, 4, 5, and *6a* are schematic cross sectional views illustrating second, third, fourth and fifth embodiments of the invention, respectively;

FIG. *6b* is a bottom plan view of the fifth embodiment; and

FIGS. *7a* and *7b* are diagrammatic representations illustrating conventional sheet separating devices.

DETAILED DESCRIPTION OF THE EMBODIMENTS

Now, preferred embodiments of the present invention will be described with reference to the accompanying drawings.

Figure 1:
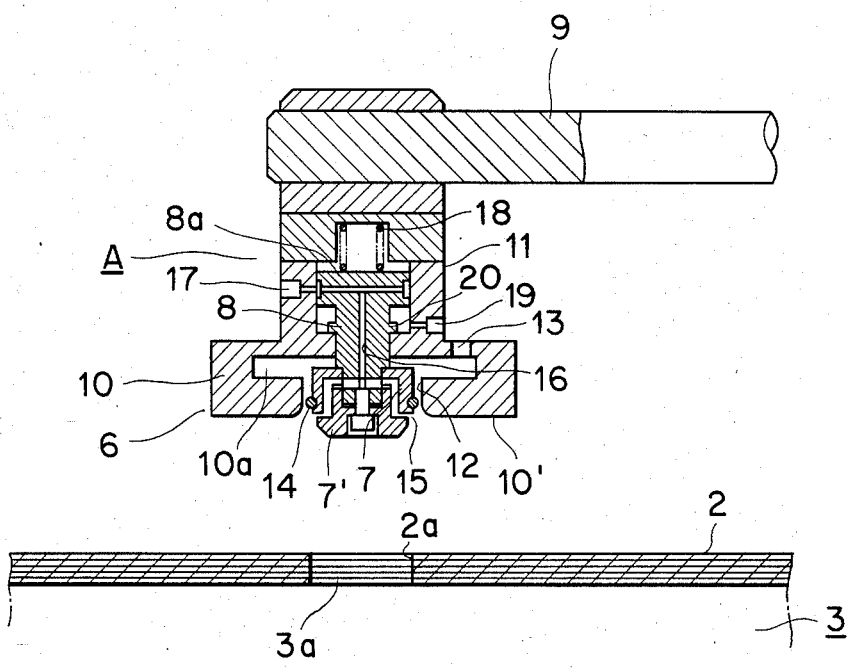
FIG. 1 is a cross sectional view illustrating a first embodiment of the present invention.

FIG. 1 illustrates a first embodiment of a sheet separating device according to the invention. A separating device body A includes a generally disc-shaped outer member 6, an inverted cup-shaped inner member 7 and a liftable member 8, and can be positioned above a stack 3 of sheet materials 2 by an external actuator 9.

The outer member 6 has a disc-formed base portion 10 and a cylindrical housing portion 11 located at the center of and extending upwardly from an upper face of the base portion. Said base portion 10 has a contact surface 10' which extends in a horizontal plane and in facing relation to the stack 2. The inner member 7 is mounted for axial movement in a sectional chamber 10*a* formed within the base portion 10*a* of the outer member 6 while the liftable member 8 is mounted for axial movement within the housing portion 11 of the outer member 6 relative thereto. Said suction chamber 10*a* has an opening in the center of the contact surface 10'.

Said opening and said inner member have dimensions a little larger than a single hole 3*a* defined in the stack 2 by holes 2*a* formed in the center of the sheet materials 2 such that said inner member 7 overhangs the inner edge of the top sheet material. Said inner member 7 is connected to an axial end (a lower end in FIG. 1) of the liftable member 8. Said inverted cup-shaped inner member 7 defines an annular suction gap 12 in cooperation with said generally disc shaped outer member 6. Within said inverted cup-shaped inner member 7, there is provided an auxiliary inner member 7' which is partially projected outward from said opening of the suction chamber 10*a* of the outer member 6. Said auxiliary inner member 7' is attached to the inside of the inverted cup-shaped inner member. Since said auxiliary inner member 7' projects outward from the opening of the suction chamber 10*a* and has a size smaller than said single hole, said member 7' normally faces the single hole in the stack but can be inserted thereinto when the body A is lowered.

Said annular suction gap 12 is more specifically defined between an outer circumferential face of the inner member 7 and an inner circumferential face of the suction chamber 10*a* of the outer member 6 and is connected to a vacuum pump (not shown) via a vacuum source port 13 formed in an upper wall of the base portion 10 of the outer member 6. An O ring 14 is provided substantially at a mid height portion of an outer circumferential face of the inner member 7 such that it is positioned adjacent the opening plane of the suction chamber 10*a* of the outer member 6 (refer to FIG. 1) when the sheet separating device is in its inoperative condition and it may be retracted into the suction chamber 10*a* (refer to FIGS. 2*b* and 2*c*) when the sheet separating device is operated. An air blow-out opening 15 is defined by the inner member 7 and the auxiliary inner member 7' below the O ring 14. It is to be noted that the O ring 14 may be replaced by a sheet member mounted on the inner member 7 by securing means such as soldering or the like.

The air blow-out opening 15 is connected to an air path 16 which is formed at the center of and extends axially through the liftable member 8. The air path 16 is opened at an outer circumferential face of a flange 8*a* provided at the other end (an upper end in FIG. 1) of the liftable member 8 and is connected in turn to an air compressor (not shown) via an air blow port 17 provided in a circumferential wall of the housing portion 11 of the outer member 6.

A spring 18 is located between an end face of the flange 8*a* of the liftable member 8 and an inner end face of the housing portion 11 of the outer member 6, and an operating air port 19 is provided in the circumferential wall of the housing portion 11 adjacent the base portion 10. Thus, if air is introduced into housing portion 11 from the operating air port 19, the liftable member 8 is lifted against the urging of the spring 18. On the other hand, if the air within the housing portion 11 is released to the atmosphere by way of the operating air port 19, the liftable member 8 is lowered by the restoring urging force of the spring 18. The liftable member 8 may otherwise be moved by a motor without utilizing a pneumatic force. In this case, the spring 18 can be omitted.

The liftable member 8 has provided at an intermediate position on the outer circumferential face thereof a stopper portion 20 for preventing the liftable member 8 from being removed from the housing portion 11 of the outer member 6.

Operations of the embodiment described above will be described below with reference to FIGS. 2*a* to 2*c*.

Figure 2A:
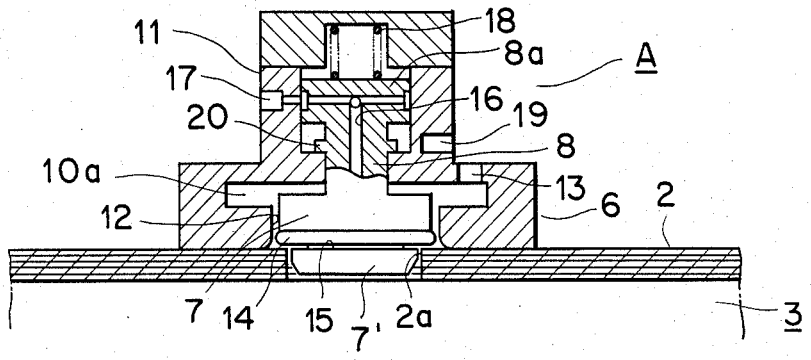
Figure 2B:
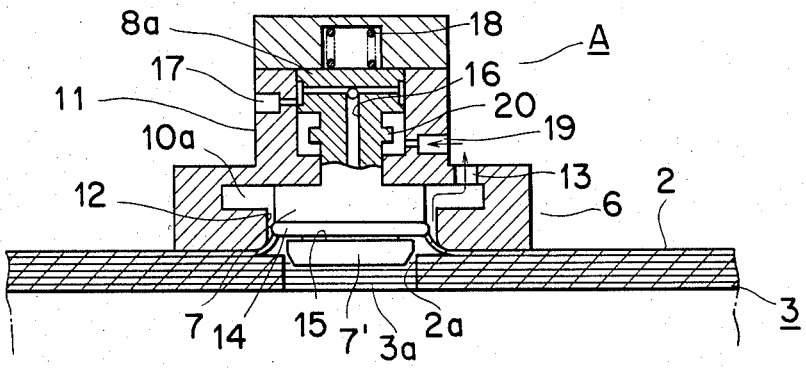
Figure 2C:
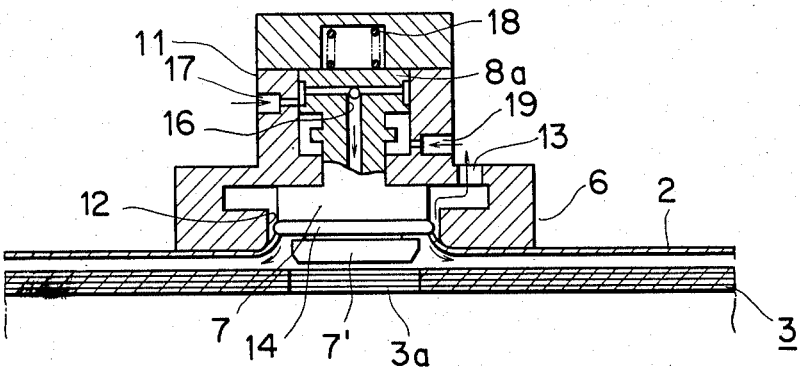

The external actuator 9 is first operated to lower and position the separating device body A on a stack 3 of sheet materials 2 with the inner member 7 inserted in the holes 2*a* of the sheet materials 2 (refer to FIG. 2*a*). Then, the vacuum pump is operated to attract an inner circumferential edge portion of the first top sheet material 2 into the suction gap 12. Then, air is supplied into the housing portion 11 of the outer member 6 from the operating air port 19 so that the liftable member 8 is lifted to retract the inner member 7 into the suction 10*a*. As a result, the inner circumferential edge portion of the first top sheet material 2 is drawn up to present a truncated conical configuration as shown in FIG. 2*b*. In this instance, the second sheet material 2 remains in its position since an elastic force of itself prevails over a contacting force between the first and second sheet materials 2.

Subsequently, air from the air compressor is blown from the air blown-out opening 15 into a gap between the first and second sheet materials 2 to form an air layer between the two sheet materials 2. At this instant, the inner circumferential edge portion of the first sheet material 2 is blocked by and closely contacted with the O ring 14 to close the suction gap 12, thereby preventing air from the air blown-out opening 21 from being sucked into the suction gap 12.

After that, the external actuator 9 is operated again to lift the separating device body A while the air within the housing portion 11 of the outer member 6 is released to the atmosphere by way of the operating air port 19. As a result, the first sheet material 2 is removed from the stack 3.

By repeating such a sequence of operations, the sheet materials 2 are assuredly separated one by one from the stack 3.

FIG. 3 illustrates a second embodiment of the present invention. In the second embodiment, a plurality of suction holes 21 are formed in suitably circumferentially spaced relationship around the opening of the suction chamber 10*a* and are opened to a bottom face of a base portion 10 adjacent a circumferential edge of an outer member 6 so that, in addition to the suction gap 12, the suction holes 21 may assuredly attract and separate a large size sheet material 2.

FIG. 4 illustrated a third embodiment of the present invention. In the third embodiment, an inner member 7 is held in a stationary position by means of a securing member 8' which corresponds to the aforementioned liftable member 8 while an outer member 6 is mounted for axial movement relative to the inner member 7.

In this instance, if a sheet material 2 is attracted by suction from the suction gap 12 and the outer member 6 is pushed down as shown in phantom in FIG. 4, an inner circumferential edge portion of a first sheet material 20 will be drawn up in a truncated conical configuration from a second sheet material 2.

FIG. 5 illustrates a fourth embodiment of the present invention. In the fourth embodiment, air is introduced from a central portion (a hole 2*a*) of a stack 3 of material sheets 2 and is blown into a gap between the first and second sheet materials from an air guide space 22 which is formed in an inner member 7.

In this case, the inner member 7 or a liftable member 8 need not necessarily have an air blow-out opening 15 or an air path 16 formed therein, respectively. Accordingly, the inner member 7 and the liftable member 8 can be simplified in construction.

Figure 6A:
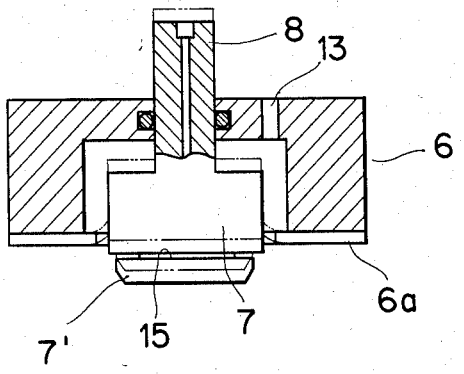
Figure 6B:
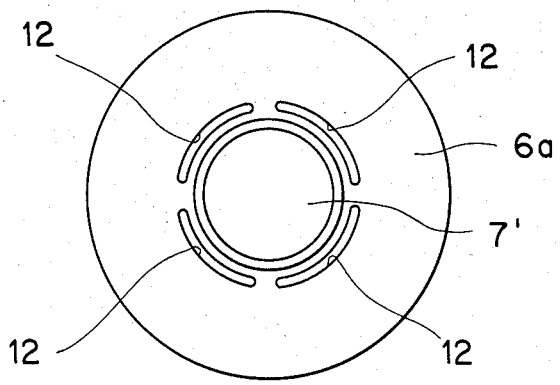
Figure 7A:
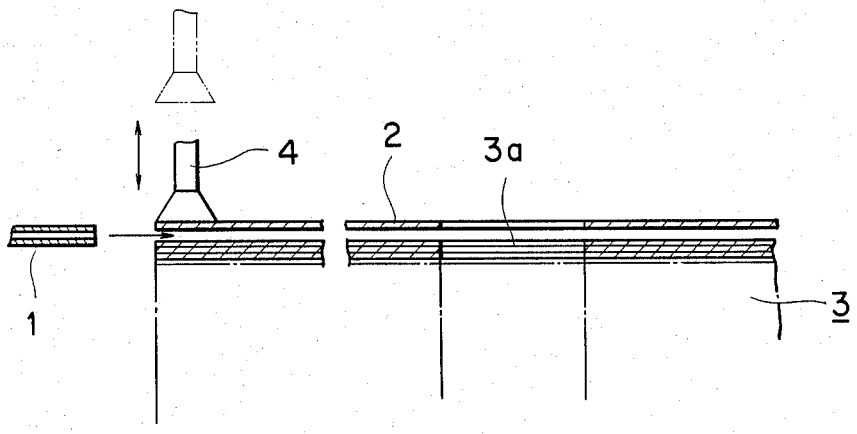
Figure 7B:
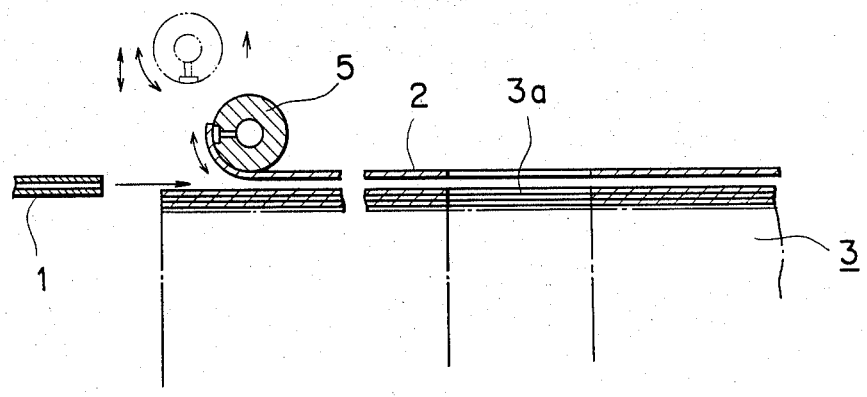

FIGS. 6*a* and 6*b* illustrate a fifth embodiment of the present invention. In the fifth embodiment, a portion 6*a* of an outer member 6 at which the outer member 6 is to be contacted with a sheet material 2 is formed in integral relationship with an inner member 7 of a resilient material such as rubber or the like while suction gas 12 extends arcuately as shown in FIG. 6*b*.

Upon attracting and separating operation, a connecting portion between the inner member 7 and the portion 6*a* of the outer member 6 is yielded as shown in phantom in FIG. 6*a* to permit movement of the inner member 7.

It is to be noted that while the air blow-out opening 15 or the air guide space 22 is provided in any of the embodiments described above to blow air between sheet materials 2, they may possibly be omitted. Where sheet materials 2 present a low elastic force, they can be separated satisfactorily only with the suction gap 12.

In addition, while operational moving means is provided for moving either the inner member 7 or the outer member 6 in an axial direction, either the inner member 7 or the outer member 6 may otherwise be mounted only for movement. Otherwise the inner and outer members 6 and 7 may both be held in stationary condition.

As apparent from the foregoing description, according to the present invention, a sheet separating device is characterized in that a suction gap is formed between an inner member which is shaped and dimensioned so as to be inserted in a hole of a sheet material and an outer member extending along an outer circumference of the inner member, an end of the inner member adjacent which the attracting force is formed being projected from the outer member. Accordingly, sheet materials can be assuredly attracted and separated one by one without being damaged, and hence the frequency of stopping of a machine for a subsequent next step due to possible troubles can be minimized while the efficiency of operation can be improved remarkably.

What is claimed is:

1. A sheet separating device for separating flexible disc-shaped sheet materials from the stack thereof, respective sheet materials having holes in the center thereof in register with each other to define a single hole in said stack, said sheet separating device comprising an outer member having a contact surface extending in a plane, said outer member being driven to bring said contact surface into and out of contact with said stack, said outer member having a suction chamber therein, said suction chamber having an opening in said contact surface, said opening having a size large enough and adapted to surround said single hole in the stack;

vacuum source means connected to said suction chamber to drawn an inner edge of a sheet material in contact with the contact surface of said outer member, said inner edge defining the hole of said sheet material;

an inner member housed in said suction chamber and shaped to define a narrow upwardly extending suction gap in cooperation with said outer member, said inner member having a size larger than said single hole to block said drawn inner edge of the top sheet material, and the inner member being relatively movable with respect to the outer member and away from the stack to thereby draw the peripheral section adjacent the hole in the uppermost flexible sheet upwardly and around the periphery of the circular opening in the contact surface of the outer member so as to separate the uppermost flexible sheet from the sheet immediately below it.

2. A sheet separating device according to claim 1, wherein said inner member has an auxiliary inner member attached to said inner member to face said single hole in the stack and having a size smaller than said single hole to allow insertion thereof, said auxiliary inner member defining a blow-out opening in cooperation with said inner member, said blow-out opening being adapted to blow-out air therefrom.

3. A sheet separating device according to claim 1, wherein each of said outer and inner members are adapted for axial movement relative to the other.

4. A sheet separating device according to claim 1, wherein said outer member is formed with a plurality of suction holes in said contact surface around said opening.

5. A sheet separating device according to claim 1, wherein said outer and inner members are of resilient material and formed into an integral body.

* * * * *